US006976907B2

(12) United States Patent
Golzarian et al.

(10) Patent No.: US 6,976,907 B2
(45) Date of Patent: Dec. 20, 2005

(54) POLISHING PAD CONDITIONING

(75) Inventors: Reza M. Golzarian, Beaverton, OR (US); Mansour Moinpour, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 27 days.

(21) Appl. No.: 10/738,549

(22) Filed: Dec. 17, 2003

(65) Prior Publication Data

US 2004/0166785 A1 Aug. 26, 2004

Related U.S. Application Data

(63) Continuation-in-part of application No. 10/340,876, filed on Jan. 10, 2003.

(51) Int. Cl.[7] ..... B24B 1/00
(52) U.S. Cl. ..... 451/56; 451/443; 451/444; 451/70; 451/72
(58) Field of Search ..... 451/56, 443, 495, 451/505, 35, 70, 72, 404, 120, 444, 285

(56) References Cited

U.S. PATENT DOCUMENTS 4,468,134 A * 8/1984 Halicho ..... 368/309
5,197,999 A 3/1993 Thomas
5,527,209 A 6/1996 Volodarsky et al.
5,665,656 A 9/1997 Jairath
5,672,096 A * 9/1997 Amarosa et al. ..... 451/504
5,707,274 A 1/1998 Kim et al.
5,779,526 A * 7/1998 Gill ..... 451/324
5,975,994 A * 11/1999 Sandhu et al. ..... 451/56
6,196,899 B1 * 3/2001 Chopra et al. ..... 451/56
6,273,798 B1 * 8/2001 Berman ..... 451/72
6,350,678 B1 2/2002 Pramanick et al.
6,663,480 B2 12/2003 Jeong et al.
6,769,968 B2 * 8/2004 So ..... 451/56

FOREIGN PATENT DOCUMENTS

JP 03 003765 A 1/1991

* cited by examiner

*Primary Examiner*—George Nguyen
(74) *Attorney, Agent, or Firm*—Schwabe, Williamson & Wyatt, P.C.

(57) ABSTRACT

An apparatus for conditioning a polishing pad of a CMP apparatus for making semiconductor wafers is provided which includes a control arm configured to extend at least partially over a polishing pad. The apparatus also includes at least one cylindrical conditioning piece coupled to the control arm where the control arm is configured to apply the at least one cylindrical conditioning piece to the polishing pad.

33 Claims, 10 Drawing Sheets

POLISHING PAD CONDITIONING

RELATED APPLICATIONS

This is a continuation-in-part of co-pending U.S. patent application Ser. No. 10/340,876 entitled "Surface Planarization" filed on Jan. 10, 2003.

FIELD OF THE INVENTION

The present invention relates to apparatus and methods for chemical mechanical planarization and, more particularly, to substrate planarization using cylindrical polishing pads and pad conditioners.

BACKGROUND OF INVENTION

Chemical mechanical planarization (CMP) is a highly utilized method of planarizing the surface of a semiconductor substrate. Polishing pads are typically used in a CMP operation.

Therefore, there is a need to condition polishing pads in an effective and highly controllable manner.

BRIEF DESCRIPTION OF THE DRAWINGS

Embodiments of the present invention will be readily understood by the following detailed description in conjunction with the accompanying drawings. To facilitate this description, like reference numerals designate like structural elements. The invention is illustrated by way of example and not by way of limitation in the figures of the accompanying drawings.

DETAILED DESCRIPTION OF EMBODIMENTS OF THE INVENTION

Figure 1:
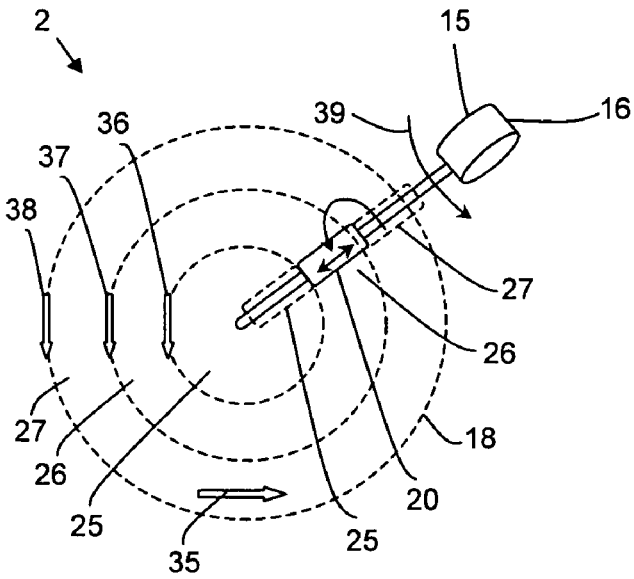
FIGS. 1–4 are top, side, side, and top views, respectively, of a CMP apparatus including a rotating substrate holder and a single cylindrical polishing pad coupled to a control arm in accordance with one embodiment of the present invention.
Figure 2:
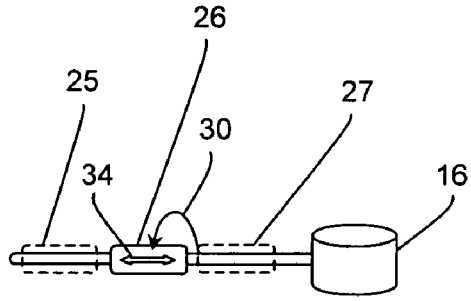
Figure 3:
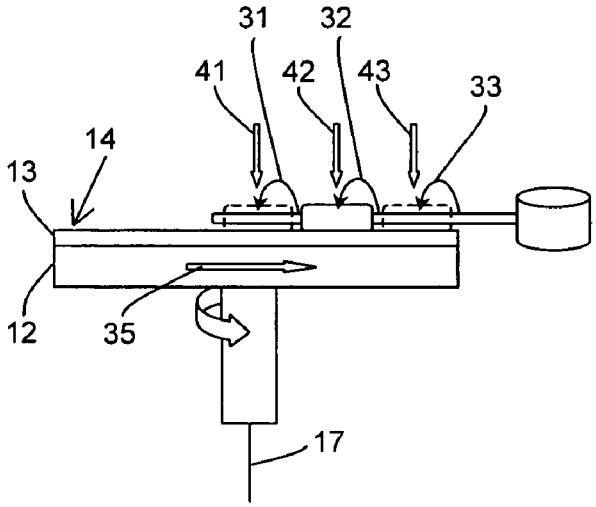
Figure 4:
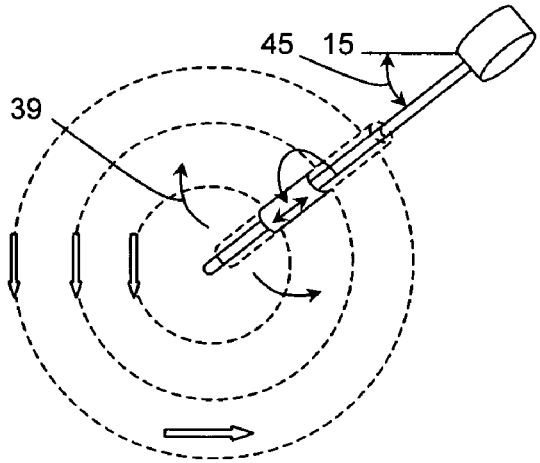

In the following detailed description, reference is made to the accompanying drawings which form a part hereof wherein like numerals designate like parts throughout, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims and their equivalents.

In the following description, reference is made to polishing pads and conditioning pieces. It is understood in the art that polishing pads are used to planarize substrates. It should be appreciated that substrates as utilized herein may be any suitable type of material such as wafers, layers in semiconductor devices, etc. It is also understood that conditioning pieces are used to clean and condition the polishing pads after filling or clogging with polishing components and wear. Embodiments of methods and apparatus in accordance with the present invention include those that are directed to providing and using cylindrical polishing pads for use on substrate surfaces and to providing and using cylindrical conditioning pieces for use on polishing pad surfaces. It is understood and appreciated that methods and apparatus that are described in terms of polishing pads may be substantially applicable to conditioning pieces and vice versa.

The embodiments of apparatus and methods in accordance with the present invention provide the ability to process semiconductor substrates more reliably, consistently and uniformly during a planarization process. The control over multiple process parameters provides the ability to process a substrate using very low pressure and very high rotational velocity that is particularly useful for planarization of ultra low-K materials. Similarly, the control over multiple process parameters provides the ability to prevent metal delamination during the planarization process, which is caused by the weak adhesion between the low-K dielectric and the metal layer.

The embodiments of apparatus and methods in accordance with the present invention provide planarization to address the WIW (with-in-wafer substrate) and WID (within-die) non-uniformities far more efficiently than known systems on the market. As the diameter of substrate increases, the velocity gradient across the substrate also increases. The apparatuses and methodologies described herein can address this issue efficiently by allowing single or multiple polishing pads to move at different velocities and different pressures on the substrate with an additional benefit of having the polishing solution dispensed at different flow rates at different locations on the substrate.

The embodiments of apparatus and methods in accordance with the present invention also provide single or multiple polishing pads to have a different rotational velocity, applied pressure (in the form of downforce and/or inflation of the polishing pads), and rate of linear positioning on the surface of the substrate to address and compensate for the WIW (with-in-wafer substrate) and WID (with-in-die) non-uniformities in planarization ability. In this configuration, the velocity of each polishing pad can be adjusted such that it will match the substrate surface velocity over a particular zone to yield a linear velocity on the surface of the substrate. This enhances planarization of WIW and WID while utilizing the application of very low pad pressure on the substrate with a high rotational velocity.

Additionally, embodiments of CMP methods and apparatus in accordance with the present invention provide single or multiple cylindrical conditioning pieces under common or individual control over various parameters that address and compensate for inconsistent polishing pad wear due to the WIP (with-in-polishing pad) and WIW (with-in-wafer) non-uniformities in planarization operations. The velocity of each conditioning piece is adjustable to provide a closer match to the polishing pad surface velocity over a particular zone to yield linear velocity on the surface of the polishing pad. The parameters that are controllable for the cylindrical pad that affect polishing/conditioning results may include at least one of a rotational velocity, radial and angular positioning and velocity, pad internal inflation pressure, contact pressure, pad morphology, and slurry-related parameters. It should be appreciated that any suitable parameters may be utilized and managed as long as the parameters are consistent with the embodiments of the present invention as described herein.

In some embodiments, the cylindrical polishing pad and the cylindrical conditioning piece may be inflatable/expandable. In such embodiments, the cylindrical polishing/conditioning piece(s) may be inflatable by fluids or mechanical forces and such inflation can be varied to adjust polishing/conditioning forces. Inflatable pads may vary polishing/conditioning forces in very minute and accurate forces due to the small inflation increments for increased wafer polishing control and management.

The embodiments described in FIGS. 1 through 12B describe polishing pads that may be utilized to polish semiconductor wafers during CMP operations. The polishing pads may be made out of any suitable material or combination of materials as known to those skilled in the art such as, for example, polymers such as rubbers, polyurethane, polyester, organometallic materials, metallic materials etc., as long as the material(s) can facilitate CMP operations as described herein. The polishing pad as described herein may also have any suitable type of internal structure such as, for example, porous, solid structure, semi-solid, abrasives, etc. In addition, the polishing pad as described herein may also have a combination of a porous structure along with additives to enhance the polishing properties of the polishing pad. Therefore, as utilized herein, the cylindrical polishing pad may be attached to an arm-like apparatus that can extend the polishing pad to any suitable region of a substrate desired to be polished. It should be appreciated that the arm-like apparatus may be made from any suitable material and may be configured in any suitable fashion as long as the cylindrical polishing pad is attachable to the arm-like apparatus, and the cylindrical polishing pad may be rotated and applied to a substrate being processed in accordance with the apparatuses and methodology described herein.

FIGS. 1–4 are top, side, side, and top views, respectively, of a CMP apparatus 2 including a rotating substrate holder 12 and a single cylindrical polishing pad 20 coupled to a control arm 16 in accordance with one embodiment of the present invention. The substrate holder 12 may carry the substrate 13 in a horizontal position with the surface 14 of the substrate 13 to be polished facing upward. It should be appreciated that although the exemplary embodiments of FIGS. 1–4 show the substrate 13 in a horizontal position, the substrate 13 may be placed in any suitable orientation that enables polishing such as, for example, horizontal orientation, a vertical orientation, an angled orientation between a vertical and horizontal orientations, etc. In addition, the substrate 13 may also be polished while in a substantially downward facing position as well as a substantially upward facing position or any position there between. The substrate holder 12 may be configured to rotate the substrate 13 at a constant or variable velocity (Vs) 35 where the velocity (Vs) 35 may be varied depending on the desired polishing performance. In one embodiment, when the velocity (Vs) increases, the polishing rate may increase and when the velocity (Vs) decreases, the polishing rate may decrease. Therefore, by intelligently controlling and managing the velocity 35, the polishing rate may be adjusted to the desired rate depending on the polishing operation.

The polishing pad 20 is cylindrically shaped and in one embodiment configured to couple with the control arm through a longitudinal axis. In one embodiment, the length of the polishing pad 20 is less than the radius of the substrate 13. In the embodiment as shown in FIG. 1, the length of the polishing pad 20 is approximately one-third of the radius of the substrate 13. In other embodiments, the polishing pad 20 may be any suitable fraction of the radius of the substrate 13.

In yet another embodiment, the polishing pad 20 may be equal to or greater than the radius of the substrate 13. In such an embodiment, the contact areas where the polishing pad 20 contacts the substrate 13 may be varied and the rotational velocity of the polishing pad 20 may be adjusted depending on the contact point of the polishing pad. The contact areas may be varied in location and size by changing the angle of the control arm 16 so the control arm 16 forms an acute angle between it and the substrate 13. The acute angle may be varied from 0 to 90 degrees depending on the polishing rate and polishing zone desires.

In one embodiment, the control arm 16, when in operation, may extend above the substrate holder 12 and in a position that is substantially parallel with the substrate surface 14. The control arm 16 may be adapted to pivot about a fixed point 15 adjacent the substrate holder 12 with a rotation velocity 39 and position 45. In one embodiment, the control arm 16 is configured to accept a cylindrical polishing pad 20 and to linearly translate the polishing pad 20 along the control arm 16 at a translation velocity (Vt) 34 and parallel with the substrate surface 14. As stated above, in other embodiments, the control arm 14 may be configured so that the control arm 16 is at an acute angle to the substrate 13. In one embodiment, the control arm 16 may be configured to position the polishing pad 20 at predetermined locations on the substrate surface 14 from at least the rotation axis 17 of the substrate holder 12 to the edge 18 of the substrate 13. In the embodiment as shown in FIGS. 1 through 4, three polishing pad 20 positions may be defined as the center 25, middle 26 and edge 27 positions although other positions may be defined. Therefore, in one embodiment, the control arm 16 is configured to linearly translate the polishing pad 20 within the three polishing pad positions and overlapping some portion of one or more polishing pad positions. It should be understood that there may be any suitable numbers, size, locations, and shapes of the predetermined locations depending on the type of polishing desired. In other embodiments, there does not have to be any predetermined locations, so depending on the polishing location and the how the polishing is proceeding, the rotation and translation of the polishing pad 20 may be varied so the polishing pad 20 may be applied to any suitable portion of the substrate. In addition, as discussed below, the rotational speed of the substrate 13 as well as the inflation of the polishing pad 20 and the downforce applied by the polishing pad 20 may also be varied to enhance the polishing operation.

The control arm 16 may be configured to rotate the polishing pad 20 about the longitudinal axis of the polishing pad 20. The rotation velocity (Vp) 30 of the polishing pad 20 is variable and may be adjusted for the polishing performance desired. In one embodiment of the method of the present invention, the Vp 30 of the polishing pad 20 is adjusted with radial position on the substrate 13. All other factors being unchanged, as the rotation velocity 30 increased, the polishing rate may increases and as the rotation velocity 30 may decrease, the polishing rate decreases.

In one embodiment, the control arm 16 is adapted to place the polishing pad 20 in contact with the substrate 13 at a predetermined pressure (P) 40. The pressure 40 can be constant or continuously varied at one location or varied with position (Pc 41, Pm 42, Pe 43), along the radius of the substrate 13. In addition, as discussed below in FIGS. 12A and 12B, the polishing pad 20 may be placed in close proximity to the substrate 13 and inflated thereby initiating the contact with the substrate 13 through the inflation of the polishing pad 20.

In one embodiment of the method of the invention, the pressure 40 may be continuously varied across the substrate 13 and the polishing pad 20 can be translated back and forth along the control arm 16 to compensate for the velocity differential along the radius of the substrate 13, from the rotation axis 17 to the edge 27. In another embodiment, the control arm 16 may be configured to itself move and in turn move the polishing pad 20 from a center of the substrate 13 to a perimeter of the substrate 13 along a radius of the substrate. In yet another embodiment, the control arm 16 may be configured to move the polishing pad 20 along any other suitable path to polish the regions of the substrate 13 desired such as a zig zag pattern, arc-like pattern, random pattern, etc. The velocity differential between the center of the substrate 13 and the periphery/perimeter of the substrate 13 is greater as the radius of the substrate 13 is larger. Therefore, by varying the rotational velocity of the polishing pad 20 (as well as adjusting other factors), the polishing rate across the substrate 13 may be normalized. In one embodiment, the polishing pad 20 position and translation velocity (Vt) 34, polishing pad rotation velocity (Vp 35, Vc 36, Vm 37, Ve 38), pad pressure (P) 40, control arm rotation velocity (Cv) 39 and position (Cp) 45, and substrate 13 rotation velocity (Vs) 35 may be controlled based on the feedback from an in-situ process/substrate surface metrology system to address a particular non-uniformity on the surface 14 of the substrate 13. Therefore, where the differential velocity is typically greater such as, for example, at the circumference of the substrate 13, the differential velocity between the polishing pad 20 and the substrate 13 at that location may be adjusted to keep the differential velocity substantially the same as that of differential velocity between the polishing pad 20 and the center of the substrate 13.

FIGS. 5–8 are top, side, side, and top views, respectively, of a CMP apparatus 4 including a rotating substrate holder 12 with multiple cylindrical polishing pads 20*a*, 20*b*, 20*c* co-axially coupled to a control arm 46 in accordance with one embodiment of the present invention. The substrate holder 12 may carry the substrate 13 in a substantially horizontal position with the substrate surface 14 to be polished facing upward. As discussed in reference to FIGS. 1–4, the substrate surface 14 may be faced in any suitable direction such as substantially upward, substantially downward and any position in between. The substrate holder 12 may rotate the substrate 13 at a constant or variable velocity depending on the desired polishing rate at different regions of the substrate 13.

Figure 5:
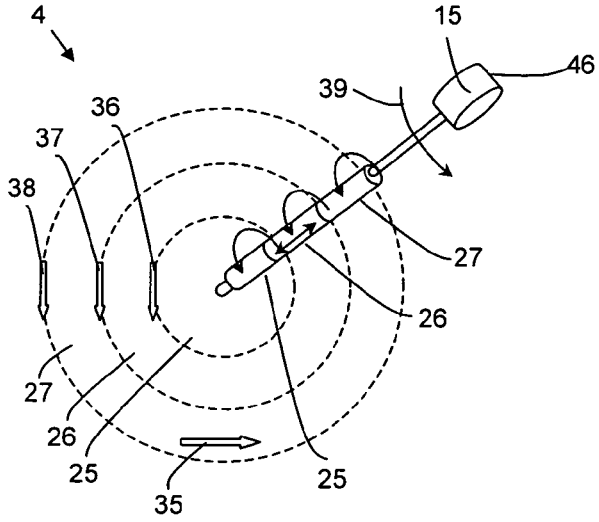
FIGS. 5–8 are top, side, side, and top views, respectively, of a CMP apparatus including a rotating substrate holder with multiple cylindrical polishing pads co-axially coupled to a control arm in accordance with one embodiment of the present invention.
Figure 6:
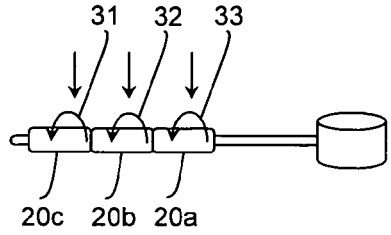
Figure 7:
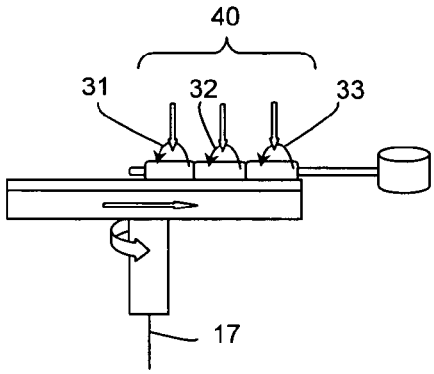
Figure 8:
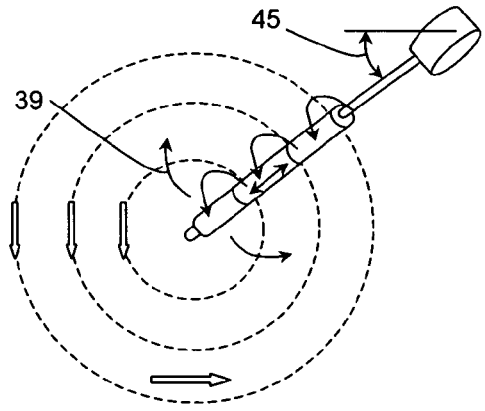

In one embodiment, the polishing pads 20*a*–*c* are cylindrically shaped and configured to couple with the control arm through a longitudinal axis. The length of each polishing pad 20*a*–*c* may, in one embodiment, be less than the radius of the substrate 13. A plurality of polishing pads 20*a*–*c* can be used simultaneously to cover the substrate surface 14. In the embodiment of FIG. 5, the plurality of polishing pads 20*a*–*c* can be utilized and the length of each polishing pad 20*a*–*c* may be approximately one-third of the radius of the substrate 13. In other embodiments, the length of each polishing pad 20*a*–*c* may be any suitable fraction of the radius of the substrate 13. In yet another embodiment, the polishing pad 20*a*–*c* may be equal to or larger than the radius of the substrate 13.

In one embodiment, the control arm 46, when in operation, may extend above the substrate holder 12 and may be substantially parallel with the substrate surface 14. In other embodiments, as described in reference to FIGS. 1–4, the control arm 46 may be an acute angle to the substrate surface 14. The control arm 46 may be configured to pivot about a fixed point 15 adjacent the substrate holder 12 in a sweeping manner with a control arm rotation velocity (Cv) 39 and position (Cp) 45. The control arm 46 can accept multiple cylindrical polishing pads 20*a–c*. In one embodiment, the polishing pads 20*a–c* may remain at a fixed position along the length of the control arm 46. The control arm 46 may place the polishing pads 20*a–c* substantially parallel to the substrate surface 14 (or at an acute angle to the substrate surface 14 depending on the embodiment utilized) and in contact with the substrate surface 14. In the embodiment of FIG. 5, each of the three polishing pads 20*a–c* can defines either a center 25, middle 26 or edge 27 position. It should be appreciated that the regions utilized in FIG. 5 are merely exemplary and any number, size, and shape of regions may be polished in any suitable range of polishing rates.

The control arm 46 may be configured to rotate the polishing pads 20*a–c* about the polishing pad's longitudinal axis. Each pad rotation velocity (Vpc 31, Vpm 32, Vpe 33) may be variable, independent, and selected depending on the polishing rate desired. In one embodiment of the method of the present invention, the rotation velocity 31, 32, 33 of the polishing pads 20*a–c* may be adjusted depending on the radial position on the substrate 13. Where the tangential velocity of the substrate 13 is great, the rotational velocity of the polishing pad may be less and where the tangential velocity of the substrate 13 is less, the rotational velocity of the polishing pad may be greater thus normalizing the polishing rates across the entire substrate 13 to obtain a consistent polishing operation.

In one embodiment, the control arm 46 may be adapted to place the polishing pads 20*a–c* in contact with the substrate 13 at a predetermined constant pressure (Pc 41, Pm 42, Pe 43) or in another embodiment, the pressure 41, 42, 43 can be varied during the polishing operation depending on the polishing status and the type of polishing desired for certain regions of the substrate 13. In addition, as discussed above in reference to FIGS. 1–4 and FIGS. 12A to 12B below, the polishing pads 20*a–c* may be inflatable. Therefore, the level of inflation may be utilized to determine the polishing pressure applied to the substrate 13.

In one embodiment present the invention, each of the pad rotation velocity 31, 32, 33 of each polishing pad 20*a–c* may be selected to compensate for the substrate velocity 36, 37, 38 differential along the radius of the substrate 13. The velocity differential is greater as the radius of the substrate 13 is larger. The polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35 may be controlled based on the feedback from an in-situ process/substrate surface metrology system to address a particular non-uniformity on the substrate surface 14. In such a system, the polishing rate of the substrate 13 can be measured in different portions of the substrate 13. Therefore, through a feedback loop system, the polishing rates at different portions of the substrate 13 may be controlled, managed, and varied depending on the polishing rate feedback from the surface metrology system. It should be appreciated that any suitable type of control system and feed back loop system that can be utilized to measure the progress of substrate polishing as known to those skilled in the art.

Figure 9:
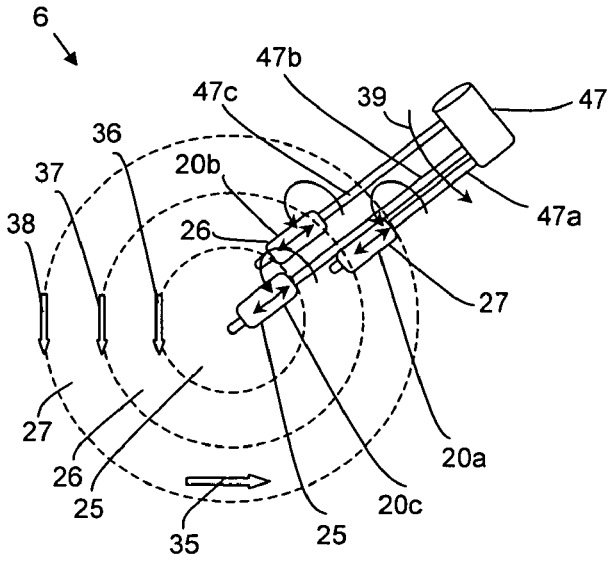
FIG. 9 is a top view of a CMP apparatus comprising a rotating substrate holder and a single cylindrical polishing pad coupled to each of three independent control arms coupled in parallel relationship to each other as a unit at a single pivot point in accordance with one embodiment of the present invention.

FIG. 9 is a top view of a CMP apparatus 6 including a rotating substrate holder 12 and a single cylindrical polishing pad 21*a–c* coupled to each of three independent control arms 47*a–c* coupled in parallel relationship to each other as a unit 47 at a single pivot point 15 in accordance with one embodiment of the present invention. The substrate holder 12 may carry the substrate 13 in a substantially horizontal position with the substrate surface 14 to be polished facing upward. It should be appreciated that the substrate holder 12 may be configured to place the substrate 13 in any suitable orientation such as, for example, substantially vertical orientation, substantial horizontal orientation, and any orientation there between. The substrate holder 12 can be configured to rotate the substrate 13 at a constant or variable velocity depending on the polishing rate desired. In one embodiment, a higher the velocity of rotation of the substrate holder 12 may result in a higher the polishing rate when the rotation of the polishing pads are kept at a constant rate. It should be appreciated that the rotational rate of the polishing pads 21*a–c* and the substrate holder 12 may be varied in accordance with each other to vary the polishing rate.

Each polishing pad 21*a–c* may be cylindrically shaped and adapted to couple with one of the control arms 47*a–c* through the longitudinal axis. As discussed above, the length of each polishing pad 21*a–c* may be less than the radius of the substrate 13. In the embodiment as shown in FIG. 9, the length of each polishing pad 21*a–c* is approximately one-third of the radius of the substrate 13. In other embodiments, each of the polishing pads 21*a–c* may extend across any suitable fraction of the radius of the substrate 13. In yet other embodiments, each of the polishing pads 21*a–c* may be equal to the radius or greater than the radius of the substrate 13. In such embodiments, the angle of contact of the polishing pads 21*a–c* may be adjusted to determine the size of the contact patch between the polishing pads 21*a–c* and the substrate 13.

In one embodiment, each of the control arms 47*a–c*, when in operation, may extend above the substrate holder 12 and be substantially parallel with the substrate surface 14. As discussed above in reference to FIGS. 1–4, in other embodiments, the control arms 47*a–c* may be at an acute angle to the surface of the substrate surface 14. The control arms 47*a–c* may be configured to pivot as a unit 47 about a fixed point 15 adjacent the substrate holder 12 in a sweeping manner at a rotational velocity (Cv) 45. Each control arm 47*a–c* may be configured to accept a cylindrical polishing pad 20*a–c*. Each of the control arms 47*a–c* may be adapted to linearly translate a polishing pad 20*a–c* along the control arm 47*a–c* and be substantially parallel with the substrate surface 14. In other embodiments, the control arm 47*a–c* may itself move and in turn move the polishing pads 20*a–c*. In one embodiment of FIG. 3, three polishing pad positions are defined as the center 25, middle 26 and edge 27. It should be appreciated that any suitable number, size, and locations of polishing pad positions may be utilized by the apparatus and methods as described herein. In one embodiment, each of the control arms 47*a–c* is configured to position a polishing pad 20*a–c* at predetermined locations on the substrate surface 14. In such an embodiment, the control arm 47*a* can position the polishing pad 20*a* at a defined center 25 position, the control arm 47*b* can position the polishing pad 20*b* at a defined middle 26 position, and the control arm 47*c* can position the polishing pad 20*c* at a defined edge 27 position. Each of the control arms 47*a–c* may be configured to linearly translate the polishing pad 20*a–c* to at least one of the three polishing pad positions 25, 26, 27 and to positions overlapping some portion of one or more polishing pad positions 25, 26, 27.

Each of the control arms 47*a–c* may be configured to rotate the polishing pad 20*a–c* about the polishing pad's longitudinal axis. The polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35, and inflation level of the polishing pads 20*a–c* may be preset or varied based on the feedback from an in-situ process/substrate surface metrology system to address a particular non-uniformity on the substrate surface 14. Therefore, if the feedback system determines that a polishing rate for a particular region of the substrate 13 is too high then the polishing pad rotation velocity, control arm rotation velocity, the polishing pad pressure, polishing pad inflation level, and/or the substrate rotation velocity may be decreased. Conversely, if the polishing rate is too low for a particular region, the variables discussed above, in any suitable combination, may be changed to increase the polishing rate such as, for example, increasing the polishing pad pressure, polishing pad rotation velocity, substrate rotation velocity, etc. Therefore, depending on the polishing dynamics desired, some variables may be increased and some may be decreased. Consequently, for example, the rotation velocity of each polishing pad 20*a–c* may be variable and independent, and is selected depending on the polishing rates desired for a particular region of the substrate 13. In such as example, the rotation velocity of each polishing pads 20*a–c* is adjusted depending on the radial position on the substrate 13 so the polishing rate across the radius of the substrate 13 may be made consistent. Other variables may be controlled independently or in conjunction with each other to obtain the desired polishing profile.

Each of the control arms 47*a–c* may be configured to place the polishing pads 20*a–c* in contact with the substrate 13 at a predetermined pressure, independent from the other polishing pads 20*a–c*. The pressure can be constant or varied at one location or variable with position along the radius of the substrate 13.

In one embodiment of the method of the invention, the polishing pressure of each polishing pads 20*a–c* may be varied across the substrate 13 and the polishing pads 20*a–c* are translated back and forth along the control arm 47*a–c* to compensate for the velocity differential along the radius of the substrate 13. The velocity differential is greater as the radius of the substrate 13 is larger because the tangential velocity at the edge of the substrate 13 is larger than the tangential velocity in the middle of the substrate 13. The polishing pad position 25, 26, 27 and translation velocity (Vtc 34*a*, Vtc 34*b*, Vte 34*c*), polishing pad rotation velocity (Vpc 31, Vpm 32, Vpe 33), polishing pad pressure (Pc 41, Pm 42, Pe 43), control arm rotation velocity (Cv) 39 and position (Cp) 45, and substrate rotation velocity 35 may be controlled based on the feedback from an in-situ process/substrate 13 surface metrology system to address a particular non-uniformity on the substrate surface 14.

Figure 10:
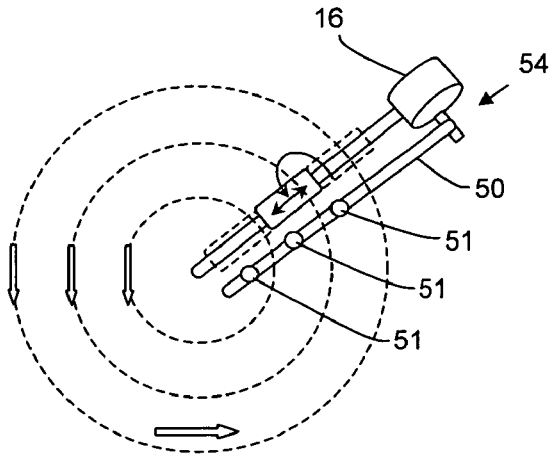
FIG. 10 is a top view of a slurry delivery system in accordance with one embodiment of the present invention.

FIG. 10 is a top view of a slurry delivery system 54 in accordance with one embodiment of the present invention. In one embodiment in accordance with the present invention, a slurry and/or polishing solution is distributed through a slurry dispensing head 50 directly onto the substrate surface 14 via one or more multiple ports 51. Depending on the polishing desired on different portions of the substrate, each one of the multiple ports 51 may dispense the same amount of slurry/polishing solution or each of the multiple ports 51 may dispense a different amount of slurry/polishing solution. Therefore, the multiple ports 51 may apply different/same amounts of slurry/polishing solution to different portions of the substrate being polished depending on the polishing profile desired for different portions of the substrate. It should be appreciated that any suitable type of slurry may be utilized as known to those skilled in the art.

Figure 11:
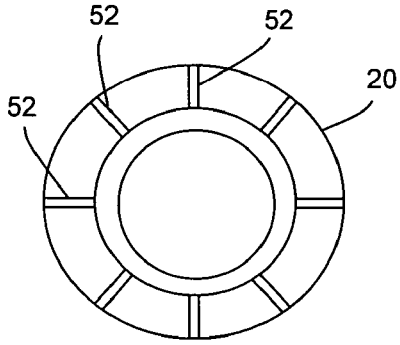
FIG. 11 is a side cross-sectional view of a polishing pad where the slurry and polishing solution are distributed through perforations in each polishing pad in accordance with one embodiment with the present invention.

FIG. 11 is a side cross-sectional view of a polishing pad 20 where the slurry and polishing solution is distributed through perforations 52 in each polishing pad 20 in one embodiment in accordance with the present invention. In one embodiment, the slurry may be inputted into an internal portion of the polishing pad 20 and outputted through the perforations 52. Therefore, the slurry may be applied to a substrate through the polishing pad 20 before and/or during the substrate polishing operation.

Figure 12A:
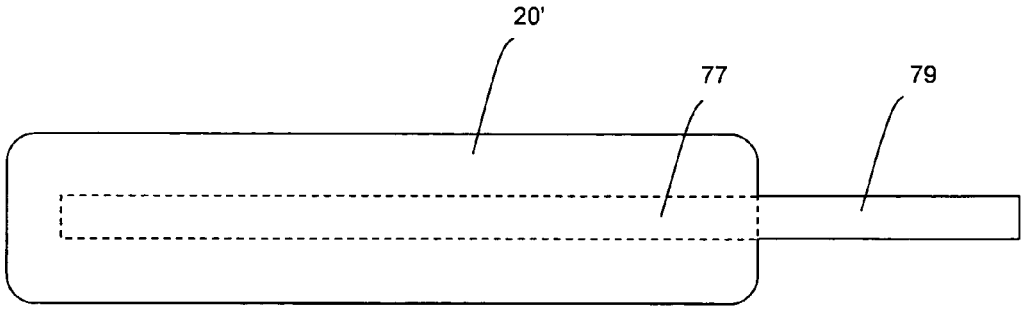
FIG. 12A illustrates an inflatable cylindrical polishing pad in accordance with one embodiment of the present invention.

FIG. 12A illustrates an inflatable cylindrical polishing pad 20' in accordance with one embodiment of the present invention. In one embodiment, the inflatable cylindrical polishing pad 20' may have a core 77 that may either be hollow to accommodate input of fluid or in another embodiment the core 77 may include mechanical arms configured to push out the inflatable cylindrical polishing pad 20'. In one embodiment when the core 77 is hollow, the core 77 may receive fluid from an input 79. The input 79 may be any suitable arm or pipe that may transport fluid into the core 77 when inflation of the inflatable cylindrical polishing pad 20' is desired. In one embodiment, any of the arms described in the present application may be utilized as the input 79 or in another embodiment, a separate hollow pipe-like apparatus may be utilized as the input 79.

Figure 12B:
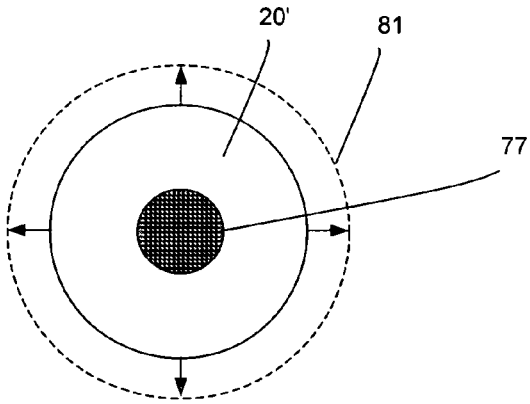
FIG. 12B shows the inflation operation of an inflatable cylindrical polishing pad in accordance with one embodiment of the present invention.
Figure 13:
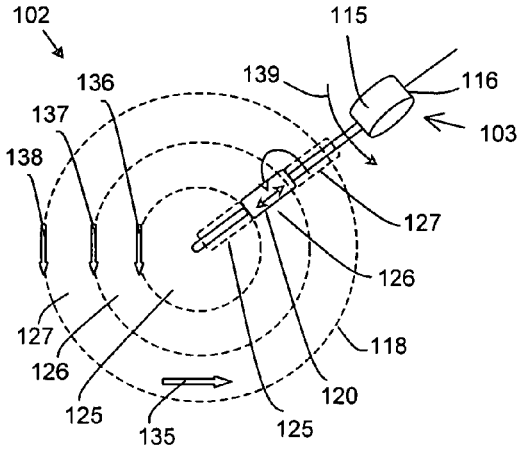
FIGS. 13–16 illustrate top, side, side, and top views, respectively, of a CMP apparatus including a polishing pad apparatus and a conditioning piece apparatus in accordance with one embodiment of the present invention.
Figure 14:
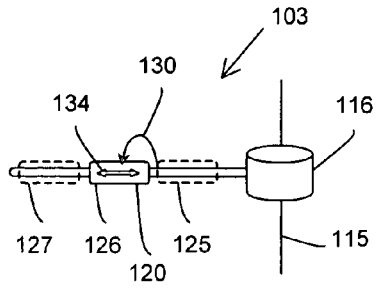

FIG. 12B shows the inflation operation of an inflatable cylindrical polishing pad 20' in accordance with one embodiment of the present invention. In one embodiment, a fluid may be inputted into the core 77 which generates outward pressure in the core 77. Therefore, the inflatable cylindrical polishing pad 20' may expand outward to a circumference 81 by the input of the fluid. It should be appreciated that the fluid may be any suitable fluid that can be inputted into the core 77 and generate outward pressure to inflate the inflatable cylindrical polishing pad 20'. It should also be understood that the level of inflation of the polishing pad 20' may be varied depending on the amount of fluid inputted into the core. In another embodiment, the core 77 may include mechanical arms that can press outward. Therefore, when the mechanical arms are actuated, the inflatable cylindrical polishing pad 20' expands to the circumference 81. It should be appreciated that the inflatable cylindrical polishing pad 20' may be used as the polishing pad in any of the embodiments described herein where a polishing pad may be utilized.

In one embodiment, the very low polishing pressures may be applied to the substrate by inflation of the pad 20'. The inflatable cylindrical polishing pad 20' may be brought into very close proximity to the substrate surface to be polished or planarized. In such an embodiment, the distance between the uninflated polishing pad 20' and the substrate surface may be determined by the inflatability of the polishing pad 20'. Therefore, after the polishing pad 20' is brought into close proximity to the substrate surface, the polishing pad 20' may be inflated or expanded in accordance with the embodiments described herein and the inflation can generate contact between the polishing pad 20' and the substrate surface to be polished. Consequently, due to the inflation, low amounts of polishing pressures may be applied to the substrate surface.

FIGS. 13–25B illustrate embodiments of the present invention for conditioning polishing pads. An apparatus for conditioning a polishing pad of a CMP apparatus for making semiconductor wafers In the embodiments described, the conditioning piece is cylindrical in shape, but it should be appreciated that the conditioning piece may be shaped in any other suitable geometric shape that can be utilized as described herein. In addition, the conditioning piece may be any suitable type of material(s) that can be utilized for conditioning polishing pads such as, for example, polymers like rubbers, polyurethane, polyester, organometallic materials, metallic materials etc. In one embodiment, the conditioning piece is a harder material than the polishing pad being conditioned. In other embodiment, the conditioning piece may be softer depending on the type of polishing pad conditioning desired. The conditioning piece may be utilized to use friction to remove unwanted substances from the polishing pad and also to remove worn sections of the polishing pad so the polishing pad may be made substantially planar or to planarize the pad to enhance the uniform removal rate uniformity or to planarize the pad to enhance removal rate uniformity.

Figure 15:
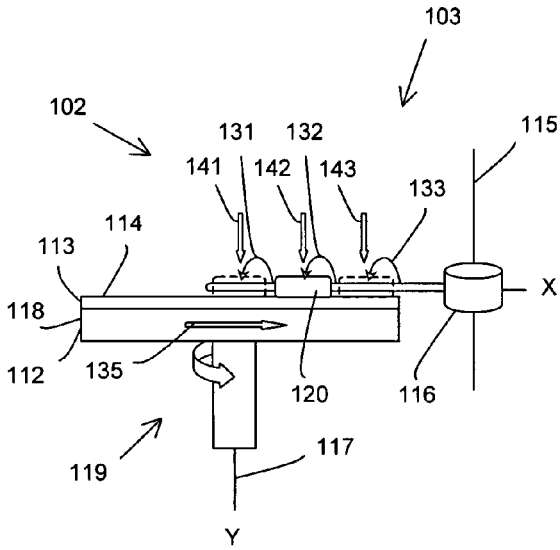
Figure 16:
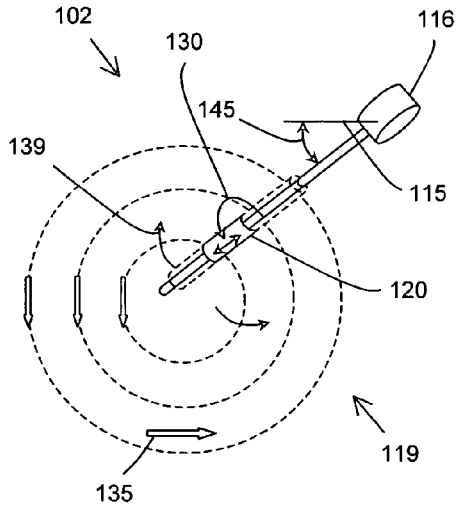
Figure 17:
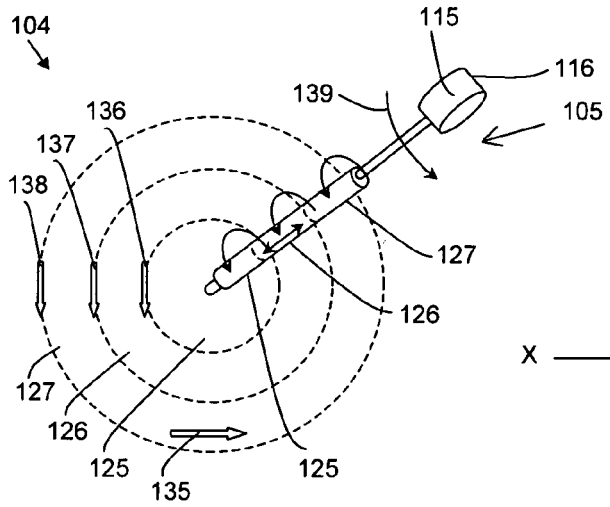
FIGS. 17–20 are top, side, side, and top views, respectively, of a CMP apparatus including the polishing pad apparatus and a conditioning piece apparatus in accordance with one embodiment of the present invention.
Figure 18:
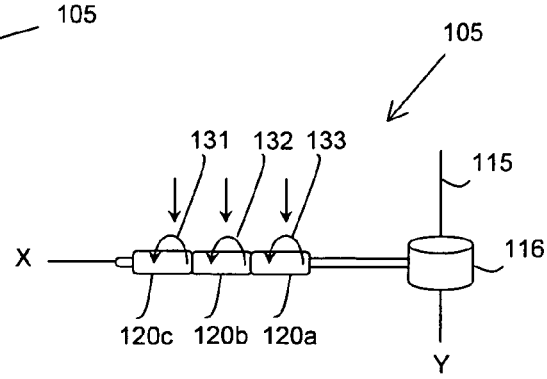
Figure 19:
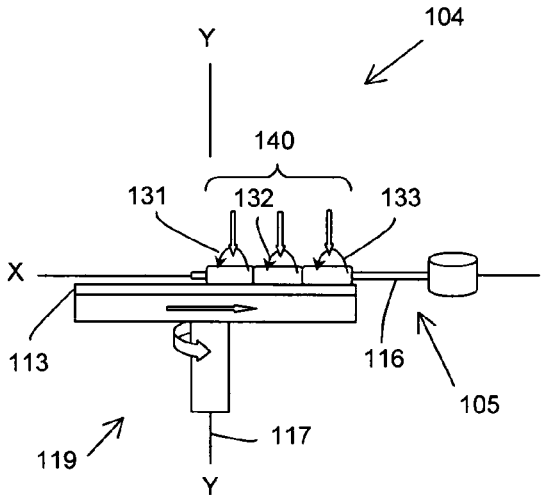
Figure 20:
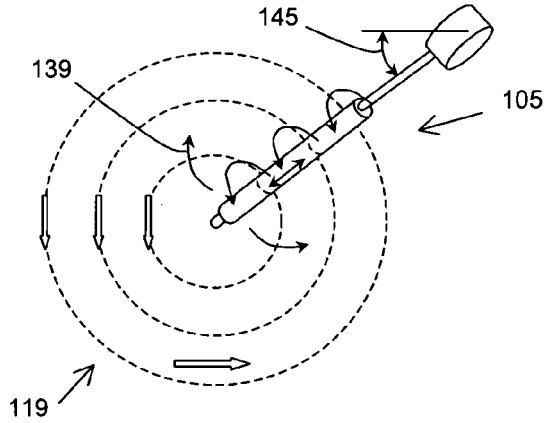

FIGS. 13–16 illustrate top, side, side, and top views, respectively, of a CMP apparatus 102 including a polishing pad apparatus 119 and a conditioning piece apparatus 103 in accordance with one embodiment of the present invention. The polishing pad apparatus 119 includes a rotating polishing pad holder 112 upon which the polishing pad 113 may be mounted or installed. In one embodiment, the polishing pad holder 112 may rotate about a Y—Y axis 117 at a constant or variable velocity (Vp) 135 that may be changed depending on the polishing rate desired. By increasing the velocity of the polishing pad, friction may be increased and therefore a greater conditioning rate may be achieved. It should be appreciated that the friction may be increased or decreased depending on the adjustment to the conditioning rate that is desired. The polishing pad 113 may be positioned upon the polishing pad holder 112 in any suitable position where the polishing surface 114 is accessible by the conditioning piece apparatus 103 during the polishing process and/or the conditioning process. In one embodiment, as shown in FIG. 15, the polishing pad 113 may be in a substantially horizontal upward facing orientation. In another embodiment, the polishing pad may be oriented in a vertical position, and in yet in another embodiment the polishing pad may be oriented in a position between a vertical orientation and a horizontal orientation. Therefore, depending on the polishing/conditioning desires, the orientation of the polishing pad may be varied.

This embodiment of the polishing pad apparatus 119 is a representative example of one of many suitable types of polishing pad apparatuses that can be utilized with the methods and apparatuses described herein. In one embodiment, the polishing pad apparatus 119 may be a rotating disk-type polishing. It should also be appreciated that the polishing pad surface 114 may be divided up into any suitable number and shape of regions for different polishing pad conditioning as long as the methodology described herein may be utilized. In one exemplary embodiment, a polishing pad surface 114 may be divided into three circular areas or positions spaced at regular intervals away from the Y—Y axis 117 such as, for example, a center position 125, a middle position 126 and a perimeter edge position 127. Each of the positions 125, 126, 127 can have a corresponding velocity Vc 136, Vm 137, Ve 138, respectively that can be varied for a desired level of polishing pad conditioning for a given polishing pad holder velocity (Vp) 135. In one embodiment, when the velocities Vc 136, Vm 137, Ve 138 are increased, the conditioning rate of the polishing pad is increased. It should also be understood that the velocities 136, 137, 138, and 135 may be varied jointly or independently depending on the conditioning desired in the particular regions of the polishing pad 113. In one embodiment, the velocities 136, 137, 138, and 135 may be independently varied so differing regions of the polishing pad may be conditioned at a same rate or a different rate.

In one embodiment, the conditioning piece apparatus 103 includes a single conditioning piece 120 that may be coupled to a control arm 116 in accordance with one embodiment of the present invention. The conditioning piece 120 may be cylindrically shaped and configured to couple with the control arm 116 through a longitudinal axis X—X. It should be appreciated that the conditioning piece 120 may be positioned in any suitable manner where the conditioning piece 120 may contact and condition the polishing pad. In one embodiment, the control arm 116 may position the conditioning piece 120 in a substantially horizontal orientation about the long axis X—X above the polishing pad surface 114.

In one embodiment, the length of the conditioning piece 120 may be predetermined to span the distance between the Y—Y axis 117 and the perimeter edge 118 of the polishing pad 113 or some fraction thereof. In another embodiment, the conditioning piece 120 may be smaller than the radius of the polishing pad 113, and in yet in another embodiment, the conditioning piece 120 may be the same or larger than the radius of the polishing pad 113. As will be apparent in the subsequent description, as the length of the conditioning piece 120 decreases, control over the conditioning process can be become more precise and more controllable. In one exemplary embodiment of FIG. 13, the length of the conditioning piece 120 may be approximately one-third the radius of the polishing pad 113.

In one embodiment, the conditioning piece 120 may linearly translate along the control arm 116 at a translation velocity (Vt) 134 and substantially parallel with the polishing pad surface 114 so as to provide full coverage or access over the entire polishing pad surface 114 as the polishing pad 113 rotates underneath. The conditioning piece 120 may be positioned at variable or predetermined locations along the radius of the polishing pad surface 114 from a center of the polishing pad to a perimeter edge 118. In one embodiment of FIG. 13, three generalized polishing pad positions 125, 126, 127 may be defined to correspond to the center, middle and perimeter positions, respectively, of the polishing pad surface 114. It should be understood that there may be any suitable number of polishing pad positions depending on the variety of conditioning environments desired. Therefore, the conditioning piece 120 can translate within the three conditioning piece positions 125, 126, 127 as well as any position there between.

In another embodiment in accordance with the present invention, the conditioning piece apparatus 103 can pivot or swing about an axis 115 so as to provide positioning about a variable swing angle 145 of the longitudinal axis X—X relative to the center of rotation of the polishing pad 113. In one embodiment, the control arm 116 may swing the cylindrical conditioning piece 120 horizontally above the polishing pad 113 with a swing velocity Vs 139 and position 145 so a substantial portion of the conditioning piece makes contact the polishing pad 113. In another embodiment, the swing angle 145 may be adjusted so a portion of the conditioning piece may contact the polishing pad 113.

The conditioning piece 120 may rotate about the longitudinal axis X—X on the control arm 116. The conditioning piece rotation velocity (Vcp) 130 may be variable and may be adjusted depending on the desired conditioning rate and conditioning intensity. In one embodiment of the method of the present invention, the Vcp 130 of the conditioning piece 120 can be varied in accordance with radial position on the polishing pad surface 114, such that the relative velocity differential between the conditioning piece 120 and the polishing pad surface 114 remains substantially consistent along the radius of the polishing pad surface 114. Therefore, the rotational velocity of the conditioning piece may be adjusted to maintain a consistent differential velocity between the rotational velocity of the conditioning piece and the rotational velocity of the polishing pad from a center of the polishing pad to an edge of the polishing pad.

In another embodiment, when the polishing pad has variable conditioning needs in different portions of the polishing pad surface, the relative velocity differential between the conditioning piece 120 and the polishing pad surface 114 may be adjusted depending on the region of the polishing pad surface 114 that is being conditioned.

The conditioning piece 120 may be configured to make contact with the polishing pad surface 114 at a pressure (P) 140 in one of a number of ways. The pressure 140 may be constant or continuously varied at any particular position on the polishing pad surface 114, such as, for example, at polishing pad positions 125, 126, 127 corresponding to a pressure (Pc) 141, (Pm) 142, (Pe) 143, respectively.

In one embodiment in accordance with present invention, the conditioning piece 120 has a variable diameter which may be changed by being inflated and deflated under a given internally applied outward pressure. It should be understood that the conditioning piece 120 may be inflated in any suitable fashion such as, for example, inflated by a fluid, inflated by outward mechanical pressure exerted from the inside of the conditioning piece, etc. The inflation of the conditioning piece 120 by fluid and by mechanical processes is described in further detail in reference to FIGS. 26A and 26B. In one embodiment, the control arm 116 positions the conditioning piece 120 substantially horizontally above the polishing pad surface 114, wherein the longitudinal axis X—X is at a predetermined vertical position with respect to the polishing pad 113 axis of rotation Y—Y. The degree of contact between the conditioning piece 120 and the polishing pad surface 114 may be determined by the diameter of the conditioning piece 120 in relationship to the distance that the long axis X—X is above the polishing pad surface 114. The diameter of the conditioning piece 120 may be configured to become larger (by aforementioned fluid pressure or gas pressure or mechanical pressure from inside of the conditioning piece 120) until contact is made at a pressure 140 with the polishing pad surface 114. The change in conditioning piece 120 diameter does not have to be great to effect a large change in contact pressure P 140 with the polishing pad 113 once contact is made.

In another embodiment in accordance with the present invention, the distance between the long axis X—X and the polishing pad surface 114, otherwise known as elevation, is a controlled variable. The long axis X—X, and thus the cylindrical conditioning piece 120, may be moved a vertical distance along axis Y—Y relative to the polishing pad surface 114 depending on the elevation desired. The contact pressure P 140 between the conditioning piece 120 and the polishing pad surface 114 can be determined by the distance of the longitudinal axis X—X above the polishing pad surface 114. The change in the distance of the long axis X—X above the polishing pad surface 114 does not have to be great to effect a large change in contact pressure between the cylindrical conditioning piece 120 and the polishing pad surface 114 once contact is made. In one embodiment, the inflation of the conditioning piece 120 may cause the surface of the conditioning piece 120 to contact and therefore condition the polishing pad surface 114. The conditioning piece 120 therefore may be moved vertically to exert a predetermined pressure 140 against the polishing pad surface 114.

The conditioning piece 120 may use a number of mechanisms for conditioning a polishing pad 113. Conditioning is defined as it is generally known in the art, and includes, but not limited to, cleaning, polishing, and/or planarizing. In one embodiment, the conditioning piece 120 may be made from a polymer material, such as, but not limited to, polymers such as, polyurethane, rubbers, polyester, organometallic materials, or metals such as stainless steel, etc. In other embodiments, the conditioning piece 120 may include configurations such as, but not limited to, an abrasive loaded fabric, bristles, abrasive loaded felt, and abrasive surface treatments, such as diamond particles.

The polishing pad 113 may be expected to not have a uniform metrology over the polishing pad surface 114. In one embodiment in accordance with the present invention, the conditioning piece rotational velocity (Vcp) 130, translation velocity (Vt) 134, and position (Ccp) 125, 126, 127, polishing pad rotation velocity (Vp) 135, (Vc) 136, (Vm) 137, (Ve) 138, contact pressure (P) 140, conditioning piece inflation, and/or control arm swing velocity (Cv) 139 and position (Cp) 145 may be independently controlled based on feedback from an in-situ polishing pad surface metrology system to address a particular non-uniformity on the polishing pad surface 114 of the polishing pad 113, and provide a uniform polishing pad surface 114.

In one embodiment of the method of the invention, the conditioning piece velocity (Vcp) 130 may be varied with radial position on the polishing pad surface 114 to yield a constant relative velocity with respect to the polishing pad surface velocity Vc 136, Vm 137, Ve 138.

FIGS. 17–20 are top, side, side, and top views, respectively, of a CMP apparatus 104 comprising the polishing pad apparatus 119 and a conditioning piece apparatus 105 in accordance with one embodiment of the present invention. The polishing pad apparatus 119 is substantially as described previously in FIGS. 13–16 above.

The conditioning piece apparatus 105 includes multiple cylindrical conditioning pieces 120*a*, 120*b*, 120*c* co-axially coupled to the control arm 116. The length of each conditioning piece 120*a*–*c* may be less than the radius of the polishing pad 113. A plurality of conditioning pieces 120*a*–*c* may be used simultaneously to condition the polishing pad surface 114. In one embodiment, the plurality of conditioning pieces 120*a*–*c* may be utilized and the length of each conditioning piece 120*a*–*c* can be approximately one-third of the radius of the polishing pad 113. In other embodiments, the length of each conditioning piece 120*a*–*c* can be a fraction of the radius of the polishing pad 113.

The control arm 146 can be adapted to accept multiple cylindrical conditioning pieces 120*a*–*c*. The conditioning pieces 120*a*–*c* may remain at a fixed position along the length of the control arm 146 or the conditioning pieces 120*a*–*c* may be configured to translate along the control arm 146. The control arm 146 may be configured to place the conditioning pieces 120*a*–*c* substantially parallel and in contact with the polishing pad surface 114. In another embodiment, the control arm may be configured to position the conditioning pieces 120*a*–*c* in close proximity to the polishing pad where inflation of the conditioning pieces 120*a*–*c* may initiate contact (and therefore conditioning) with the polishing pad. In one embodiment, each of the three conditioning pieces 120*a*–*c* can defines either a center 125, middle 126 or edge 127 position. It should be appreciated that the three conditioning pieces 120*a–c* may define any suitable position on the polishing pad as long as conditioning may occur. Each of the conditioning pieces 120*a–c* may have a rotation velocity (Vcp) 131, (Vcm) 132, (Vce) 133 that is variable, independently controlled, and selected for desired conditioning operation. Further, each conditioning piece 120*a–c* can exert a predetermined pressure (Pc) 141, (Pm) 142, (Pe) 143 that is variable, independently controlled, and selected for a desired conditioning operation. This individual control provides for a different conditioning rate or material removal rate for each conditioning piece 120*a–c*, independent of the others.

Figure 21:
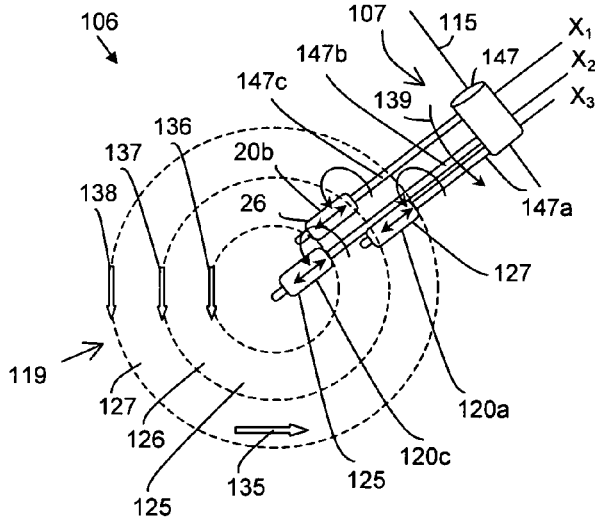
FIG. 21 is a top view of a CMP apparatus including a rotating polishing pad holder and a single cylindrical conditioning piece coupled to each of three independent control arms coupled in parallel relationship to each other as a unit at a single pivot point in accordance with one embodiment of the present invention.

FIG. 21 is a top view of a CMP apparatus 106 including a rotating polishing pad holder and cylindrical conditioning pieces 121*a–c* coupled to each of three independent control arms 147*a–c* respectively, coupled in parallel relationship to each other as a unit 147 at a single pivot point 115 in accordance with one embodiment of the present invention. In one embodiment, the polishing pad holder 112 as shown in FIG. 15 may carry the polishing pad 113 in a substantially horizontal position with the polishing pad surface 114 to be conditioned facing upward. As discussed above, the polishing pad 113 may be held in any suitable position as desired for a polishing/conditioning operation. The polishing pad holder 112 may be configured to rotate the polishing pad 113 at a constant or variable velocity depending on the conditioning rate desired. In one embodiment, the polishing pad 113 may be configured to rotate faster when a higher conditioning rate is desired and slower when a lower conditioning rate is desired.

The conditioning piece apparatus 107, in one embodiment, may include the cylindrical conditioning pieces 120*a*, 120*b*, 120*c* on each of three independent control arms 147*a–c* respectively that are coupled in parallel relationship to each other as a unit 147 at a single pivot axis 115. It should be appreciated that more or less than three control arms each with one or more conditioning pieces may be utilized depending on the polishing/conditioning operation desired. In one exemplary embodiment, the length of each conditioning piece 120*a–c* may be less than the radius of the polishing pad 113. In such an embodiment, each of the conditioning piece 120*a–c* may be configured to condition different portions of the polishing pad 113. In one embodiment as shown in FIG. 21, the conditioning pieces 120*a–c* can be utilized and the length of each of the conditioning pieces 120*a–c* may be approximately one-third of the radius of the polishing pad 113. In other embodiments, the length of each of the conditioning pieces 120*a–c* may be a suitable fraction of the radius of the polishing pad 113.

Each of the conditioning pieces 120*a*, 120*b*, 120*c* has a conditioning piece position 125, 126, 127, translation velocity (Vtc 134*a*, Vtc 134*b*, Vte 134*c*), conditioning piece rotation velocity (Vcp) 131, (Vcm) 132, (Vce) 133, conditioning piece pressure (Pc) 141, (Pm) 142, (Pe) 143), and inflation level that is variable, independently controlled, and selected for a desired conditioning operation and a conditioning rate. Together with control arm rotation velocity (Cv) 139 and position (Cp) 145, and polishing pad rotation velocity 135, the above parameters may be controlled based on, in one embodiment, the feedback from an in-situ process/polishing pad surface metrology system to address a particular non-uniformity on the polishing pad surface 114. In such a system, a feed back loop may be utilized so the conditioning rate or conditioning status may be determined and from that determination, the conditioning rate may be adjusted or varied to obtain the conditioning desired. It should be appreciated that any suitable feedback device known to those skilled in the art may be utilized to determine the conditioning rate and progression of the polishing pad surface 114. This individual control enables different conditioning rates or material removal rates for each conditioning piece 120*a–c*, independent of the others.

Figure 22:
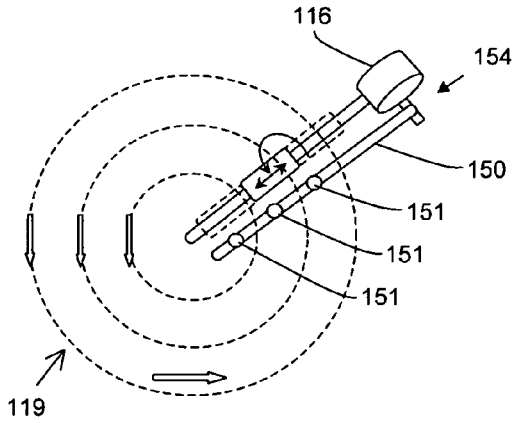
FIG. 22 is a top view of a slurry delivery system in accordance with one embodiment of the present invention.

FIG. 22 is a top view of a slurry delivery system 154, in accordance with an embodiment of the present invention. In one embodiment, slurry delivery system 15 may be utilized with the conditioning piece apparatus 103 of FIGS. 13–16. It should be understood that the slurry delivery system 154 can be used with other embodiments in accordance with the present invention. Slurry and conditioning solution may be distributed through a slurry dispensing head 150 and directly dispensed onto the polishing pad surface 114 at one or more ports 151. Depending on the conditioning desired on different portions of the polishing pad, each one of the multiple ports 151 may dispense the same amount of conditioning solution or each of the multiple ports 151 may dispense a different amount of conditioning solution. Therefore, the multiple ports 151 may apply different/same amounts of conditioning solution to different portions of the polishing pad being conditioned. The control of dispensing, flow rate, and quantity of the conditioning solution provides another mechanism for controlling the conditioning of the polishing pad 113. The conditioning solution that can be utilized may be any suitable conditioning solution as known to those skilled in the art.

Figure 23:
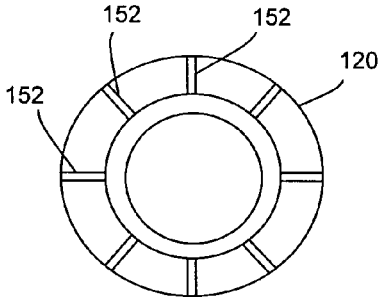
FIG. 23 is a side cross-sectional view of a conditioning piece wherein the slurry and/or conditioning solution is distributed through perforations at the surface of the conditioning piece in accordance with one embodiment of the present invention.

FIG. 23 is a side cross-sectional view of a conditioning piece 120 wherein the conditioning solution is distributed through perforations 152 at the surface of the conditioning piece 120 in one embodiment in accordance with the present invention. In this embodiment, the conditioning solution may be inputted into the core of the conditioning piece 120 and from there, the conditioning solution may be outputted to the surface of the conditioning piece 120 through the perforations 152. This dispensing method provides additional control over the placement of the conditioning solution.

FIGS. 24A–E are side perspective views of embodiments of the cylindrical conditioning piece 120-1 through 120-5 respectively, in accordance with embodiments of the present invention. It should be appreciated that the surface features as shown in FIGS. 24A–E may be utilized in a polishing pad as well as a conditioning piece. The surface features are provided to enhance and/or better control the conditioning/polishing of the conditioning/polishing pad. It should be appreciated that surface features as described in reference to FIGS. 24A–E are exemplary in nature and other suitable surface features may be utilized as long as polishing/conditioning may be accomplished effectively.

Figure 24A:
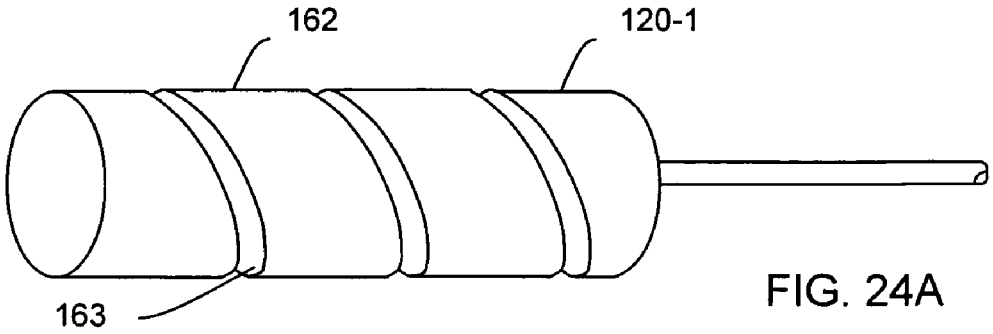
FIG. 24A illustrates a cylindrical conditioning piece including a continuous spiral groove recessed in the pad conditioning surface in accordance with one embodiment of the present invention.

FIG. 24A illustrates a cylindrical conditioning piece 120-1 including a continuous spiral groove 163 recessed in a pad conditioning surface 162 in accordance with one embodiment of the present invention. In one embodiment, the grooves 163 are provided so that a conditioning solution is channeled away from the polishing pad thereby carrying away the debris removed by the conditioning piece 120-1.

Figure 24B:
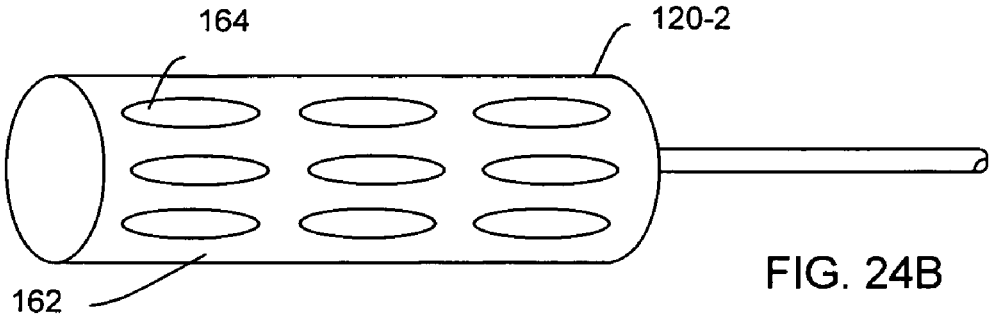
FIG. 24B illustrates a cylindrical conditioning piece including a plurality of depressions recessed in the pad conditioning surface in accordance with one embodiment of the present invention.

FIG. 24B illustrates a cylindrical conditioning piece 120-2 including a plurality of depressions 164 recessed in the pad conditioning surface 162 in accordance with one embodiment of the present invention. In one embodiment, the depressions 164 are provided so that the conditioning solution is collected and applied between the polishing pad and conditioning piece surfaces.

Figure 24C:
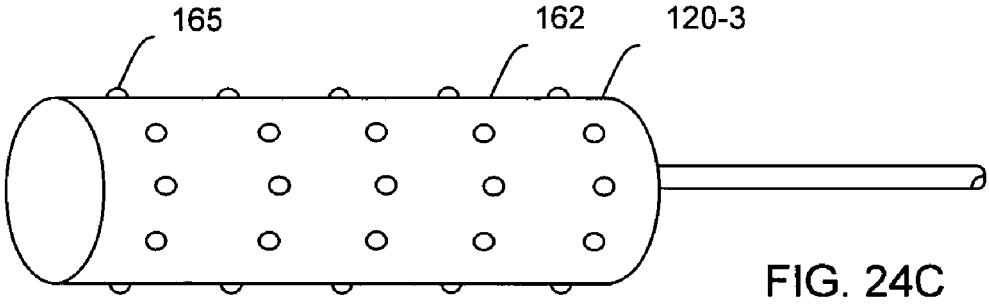
FIG. 24C illustrates a cylindrical conditioning piece comprising a plurality of raised nubs extending from the pad conditioning surface in accordance with one embodiment of the present invention.

FIG. 24C illustrates a cylindrical conditioning piece 120-3 comprising a plurality of raised nubs 165 protruding from the pad conditioning surface 162 in accordance with one embodiment of the present invention. In one embodiment, the nubs 165 are provided to enhance the removal of debris from the polishing pad. The nubs 165 geometrical configuration can provide an additional mechanical action due to high mechanical pressure (F/A) can help to lift the debris from the polishing pad surface so that the debris can be washed away.

Figure 24D:
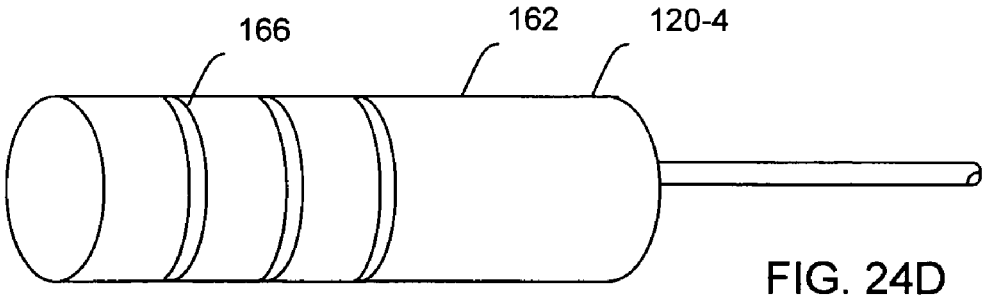
FIG. 24D illustrates a cylindrical conditioning piece comprising a plurality of individual groove rings recessed in the pad conditioning surface in accordance with one embodiment of the present invention.

FIG. 24D illustrates a cylindrical conditioning piece 120-4 comprising a plurality of individual groove rings 166 recessed in the pad conditioning surface 162 in accordance with one embodiment of the present invention. In one embodiment, the groove rings 166 are provided so that the conditioning solution may be collected and applied between the polishing pad and the conditioning piece surfaces.

Figure 24E:
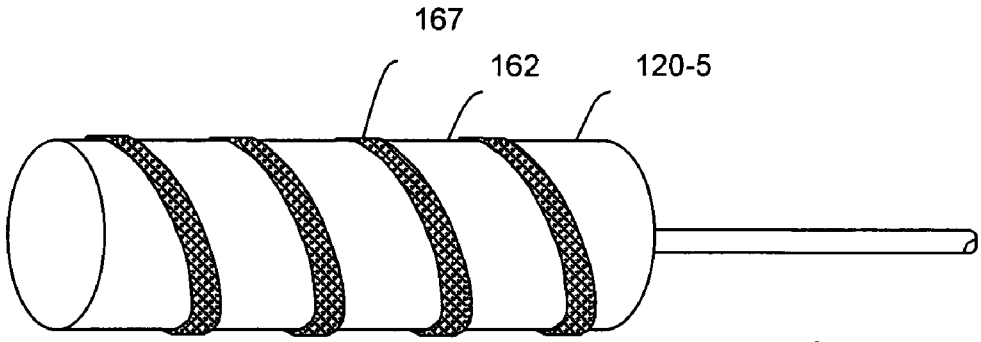
FIG. 24E illustrates a cylindrical conditioning piece comprising a continuous spiral abrasive surface, flush with or extending from the pad conditioning surface in accordance with one embodiment of the present invention.

FIG. 24E illustrates a cylindrical conditioning piece 120-5 comprising a continuous spiral abrasive surface 167, flush with or protruding from the pad conditioning surface 162 in accordance with one embodiment of the present invention. In one embodiment, the spiral abrasive surface 167 is provided to enhance material removal and planarization of the polishing pad surface.

Figure 25A:
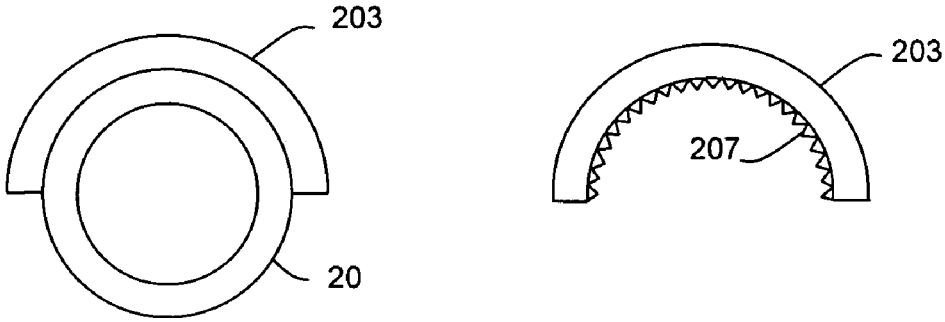
FIGS. 25A and 25B are cross-sectional and exploded cross-sectional views of a cylindrical polishing pad in mating engagement with a cleaning piece in accordance with one embodiment of the present invention.
Figure 25B:
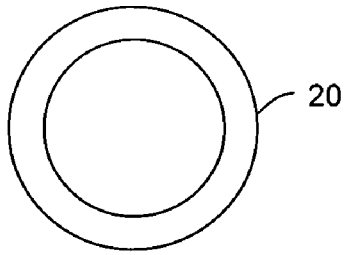

FIGS. 25A and 25B are cross-sectional and exploded cross-sectional views of a cylindrical polishing pad 20 in mating engagement with a conditioning piece 203 in accordance with the present invention. In one embodiment, the conditioning piece 203 has a semi-cylindrical shape with an inside diameter and length substantially the same as the outer diameter and length of the polishing pad 20. The conditioning piece 203 provides an apparatus for conditioning the polishing pad 20. The inner surface 207 of the conditioning piece 203 is provided with surface features to clean the surface of the conditioning piece. The surface features may include bristle, abrasives, and any other suitable conditioning enhancers.

The polishing pad 20 may be placed in close proximity with the inner surface 207 of the conditioning piece 203. In one embodiment, the polishing pad 20 can be inserted into the conditioning piece 203 in a deflated state and then inflated to enlarge the diameter and engage the inner surface 207. In another embodiment, the polishing pad 20 is inserted into the conditioning piece in an inflated state against the inner surface 207. In both embodiments, the polishing pad 20 is rotated to scrub/condition the surface of the polishing pad 20.

Figure 26A:
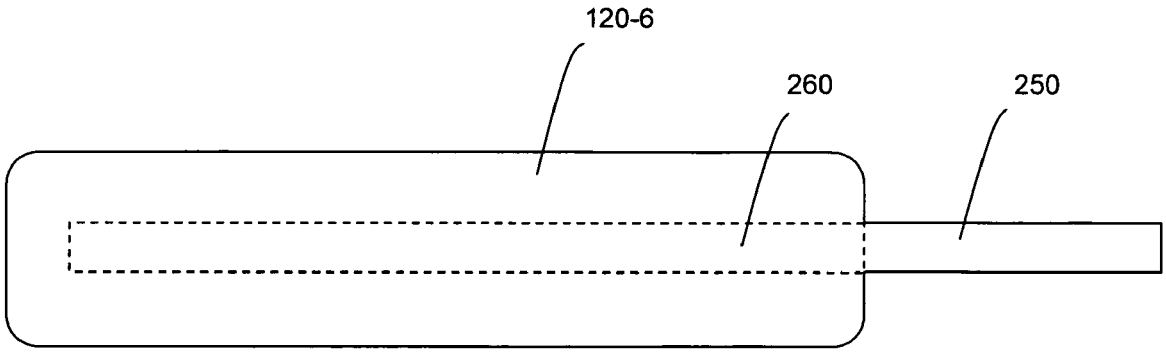
FIG. 26A illustrates an inflatable cylindrical conditioning piece in accordance with one embodiment of the present invention.

FIG. 26A illustrates an inflatable cylindrical conditioning piece 120-6 in accordance with one embodiment of the present invention. In one embodiment, the inflatable cylindrical conditioning piece 120-6 may have a core 260 that may be either be hollow to accommodate input of fluid or gas or in another embodiment the core 260 may include mechanical arms configured to push out the inflatable cylindrical conditioning piece 120-6. In one embodiment when the core 260 is hollow, the core 260 may receive fluid from an input 250. The input 250 may be any suitable arm or pipe that may transport fluid into the core 260 when inflation of the inflatable cylindrical conditioning piece 120-6 is desired. In one embodiment, any of the arms described in the present application may be utilized as the input 250 or in another embodiment, a separate hollow pipe-like apparatus may be utilized as the input 250.

Figure 26B:
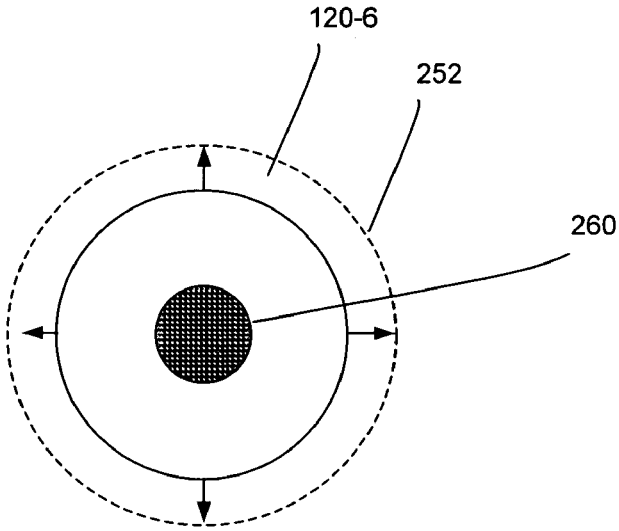
FIG. 26B shows the inflation operation of an inflatable cylindrical conditioning piece in accordance with one embodiment of the present invention.

FIG. 26B shows the inflation operation of an inflatable cylindrical conditioning piece 120-6 in accordance with one embodiment of the present invention. In one embodiment, a fluid may be inputted into the core 260 which generates outward pressure in the core 260. Therefore, the inflatable cylindrical conditioning piece 120-6 may expand outward to a circumference 252 by the input of the fluid. It should be appreciated that the fluid may be any suitable fluid that can be inputted into the core 260 and generate outward pressure to inflate the inflatable cylindrical conditioning piece 120-6. In another embodiment, the core 260 may include mechanical arms that can press outward. Therefore, when the mechanical arms are actuated, the inflatable cylindrical conditioning piece 120-6 expands to the circumference 252. Consequently, in the embodiments as described in reference to FIGS. 26A and 26B, the conditioning piece 120-6 may be positioned in close proximity to the polishing pad and by inflation, the conditioning piece 120-6 may be apply low pressure to the polishing pad. It should be appreciated that the conditioning piece 120-6 may be utilized in any suitable polishing pad conditioning embodiment as described herein.

Although specific embodiments have been illustrated and described herein for purposes of description of preferred embodiments, it will be appreciated by those of ordinary skill in the art that a wide variety of alternate and/or equivalent implementations calculated to achieve the same purposes may be substituted for the specific embodiment shown and described without departing from the scope of the present invention. Those with skill readily appreciate that the present invention may be implemented in a very variety of embodiments. This application is intended to cover any adaptations or variations of the embodiments discussed herein. Therefore, it is manifestly intended that this invention be limited only by the claims and the equivalents thereof.

What is claimed is:

1. An apparatus for conditioning a polishing pad of a CMP apparatus for making semiconductor wafers, comprising:

a control arm configured to extend at least partially over the polishing pad; and at least one cylindrical conditioning piece coupled to the control arm, the control arm configured to linearly translate the at least one cylindrical conditioning piece along a length of the control arm, and to apply the at least one cylindrical conditioning piece to the polishing pad.

2. An apparatus for conditioning a polishing pad as recited in claim 1, wherein the control arm extends over at least a radius of the polishing pad.

3. An apparatus for conditioning a polishing pad as recited in claim 1, wherein the apparatus further comprises a polishing pad holder that is configured to hold and rotate the polishing pad at a constant or variable velocity.

4. An apparatus for conditioning a polishing pad as recited in claim 3, wherein the control arm is coupled to a pivot about a fixed point adjacent the polishing pad holder.

5. An apparatus for conditioning a polishing pad as recited in claim 1, wherein a length of the at least one cylindrical conditioning piece is configured to be smaller than a radius of a polishing pad holder.

6. An apparatus for conditioning a polishing pad as recited in claim 1, wherein the control arm is configured to position the at least one cylindrical conditioning piece at predetermined locations on a polishing pad surface along the radius of the polishing pad.

7. An apparatus for conditioning a polishing pad as recited in claim 1, wherein the at least one cylindrical conditioning piece is configured to be inflatable by an outward pressure from an internal portion of the cylindrical conditioning piece to vary conditioning pressure on the polishing pad.

8. An apparatus for conditioning a polishing pad as recited in claim 7, wherein the control arm is configured to position the at least one cylindrical conditioning piece into close proximity of a surface of the polishing pad, the at least one cylindrical conditioning piece being capable of contacting the surface of the polishing pad when the at least one cylindrical conditioning piece is inflated.

9. An apparatus for conditioning a polishing pad as recited in claim 7, wherein the outward pressure may be applied by one of a fluid pressure and mechanical pressure.

10. An apparatus for conditioning a polishing pad as recited in claim 1, wherein the control arm is configured to rotate the at least one cylindrical conditioning piece about a longitudinal axis.

11. An apparatus for conditioning a polishing pad as recited in claim 1, wherein the control arm is configured to position the at least one cylindrical conditioning piece into contact with a surface of the polishing pad.

12. A method for conditioning a polishing pad surface of a polishing pad of a CMP apparatus for making semiconductor wafer, comprising:

providing a cylindrical conditioning piece to the CMP apparatus;

rotating the cylindrical conditioning piece about a longitudinal axis of the cylindrical conditioning piece; and linearly translating the cylindrical conditioning piece along the longitudinal axis of the control arm; and applying the rotating cylindrical polishing pad to the polishing pad surface.

13. A method for conditioning a polishing pad surface as recited in claim 12, wherein the method further comprises attaching the cylindrical conditioning piece to a control arm, and extending the control arm over at least a portion of a polishing pad surface.

14. A method for conditioning a polishing pad surface as recited in claim 13, wherein the method further comprises extending the control arm over at least a radius of a polishing pad in a plane that is substantially parallel to the polishing pad holder.

15. A method for cylindrical conditioning a polishing pad surface as recited in claim 13, further comprising:

angling the control arm with a pivot about a fixed point adjacent the polishing pad.

16. A method for cylindrical conditioning a polishing pad surface as recited in claim 15, wherein adjusting the rotational velocity of the cylindrical conditioning piece includes adjusting a control arm pivot position and a pivot velocity.

17. A method for conditioning a polishing pad surface as recited in claim 12, wherein rotating the cylindrical conditioning piece includes adjusting a rotational velocity of the cylindrical conditioning piece to maintain a consistent differential velocity between the rotational velocity of the cylindrical conditioning piece and a rotational velocity of the polishing pad from a center of the polishing pad to an edge of the polishing pad.

18. A method for conditioning a polishing pad surface as recited in claim 12, further comprising:

varying a conditioning rate by adjusting at least one of an inflation level of the cylindrical conditioning piece, a rotational velocity of the cylindrical conditioning piece, a rotational velocity of the rotation of the polishing pad, and a cylindrical conditioning piece downward force applied to the polishing pad.

19. A system for conditioning a polishing pad, comprising:

a polishing pad holder;

a polishing pad coupled to the polishing pad holder;

a control arm; and a cylindrical conditioning piece coupled to the arm, the arm being configured to linearly translate the at least one cylindrical conditioning piece along a length of the control arm, and to apply the cylindrical conditioning piece to the polishing pad.

20. A system for conditioning a polishing pad as recited in claim 19, wherein the control arm is capable of extending to at least a radius of the polishing pad.

21. A system for conditioning a polishing pad as recited in claim 19, wherein the control arm is configured to rotate the cylindrical conditioning piece.

22. A system for conditioning a polishing pad as recited in claim 19, wherein the polishing pad holder is a platen configured to rotate the polishing pad.

23. A system for conditioning a polishing pad as recited in claim 19, further comprising, a slurry bar configured to dispense slurry during chemical mechanical planarization.

24. A system for conditioning a polishing pad as recited in claim 23, wherein the slurry bar includes a plurality of outputs, each of the plurality of outputs being capable of outputting different amounts of fluid.

25. An apparatus for conditioning a polishing pad as recited in claim 1, wherein the control arm comprises a first control arm; and said at least one cylindrical conditioning piece comprises a first cylindrical conditioning piece.

26. An apparatus for conditioning a polishing pad as recited in claim 1, wherein the control arm comprises a first control arm; and said at least one cylindrical conditioning piece comprises an at least two cylindrical conditioning pieces.

27. An apparatus for conditioning a polishing pad as recited in claim 1, wherein the control arm comprises an at least first control arm and an at least second control arm.

28. A method for conditioning a polishing pad surface as recited in claim 12, wherein the method further comprises attaching the cylindrical conditioning piece, said cylindrical conditioning piece is a first cylindrical conditioning piece, to a control arm, said control arm is a first control arm, and extending the control arm over at least a portion of a polishing pad surface.

29. A method for conditioning a polishing pad surface as recited in claim 12, wherein the method further comprises attaching the cylindrical conditioning piece, said cylindrical conditioning piece is an at least first cylindrical conditioning piece and an at least second cylindrical conditioning piece, to a first control arm, and extending the at least first control arm over at least a portion of a polishing pad surface.

30. A method for conditioning a polishing pad surface as recited in claim 12, wherein the method further comprises attaching the cylindrical conditioning piece, said cylindrical conditioning piece is an at least first cylindrical conditioning piece and an at least second cylindrical conditioning piece, to an at least first control arm and an at least second control arm respectively, and extending the at least first control arm and the at least second control arm over at least a portion of a polishing pad surface.

31. A system for conditioning a polishing pad as recited in claim 19, wherein the control arm comprises a first control arm; and said cylindrical conditioning piece comprises a first cylindrical conditioning piece.

32. A system for conditioning a polishing pad as recited in claim 19, wherein the control arm comprises a first control arm; and said cylindrical conditioning piece comprises an at least two cylindrical conditioning pieces.

33. A system for conditioning a polishing pad as recited in claim 19, wherein the control arm comprises an at least first control arm and an at least second control arm.

* * * * *

UNITED STATES PATENT AND TRADEMARK OFFICE

CERTIFICATE OF CORRECTION

PATENT NO. : 6,976,907 B2
APPLICATION NO. : 10/738549
DATED : December 20, 2005
INVENTOR(S) : Golzarian et al.

It is certified that error appears in the above-identified patent and that said Letters Patent is hereby corrected as shown below:

Col. 19, line 21, "...piece; and" should read --...piece;--;
Col. 19, line 36, "A method for cylindrical conditioning…" should read --A method for conditioning…--;
Col. 19, line 40, "A method for cylindrical conditioning…" should read --A method for conditioning…--; and
Col. 20, lines 59-60, "...comprises an at least two…" should read --...comprises at least two…--.

Signed and Sealed this

Nineteenth Day of September, 2006

JON W. DUDAS
*Director of the United States Patent and Trademark Office*